US005282551A

United States Patent [19]

Pierson

[11] Patent Number: 5,282,551

[45] Date of Patent: Feb. 1, 1994

[54] SAFETY VALVE LOCKING DEVICE

[75] Inventor: Theodore J. Pierson, Kinnelon, N.J.

[73] Assignee: Pierson Industries, Inc., Rockaway, N.J.

[21] Appl. No.: 940,624

[22] Filed: Sep. 4, 1992

[51] Int. Cl.[5] ..... B65D 83/14

[52] U.S. Cl. ..... 222/153; 222/402.11; 251/113

[58] Field of Search ..... 222/153, 402.1, 402.11, 222/402; 251/89, 113, 115

[56] References Cited

U.S. PATENT DOCUMENTS

| | | | |
|---|---|---|---|
| 2,829,801 | 4/1958 | Ayres | 222/402.11 |
| 3,252,626 | 5/1966 | Belka | 222/402.11 |
| 3,272,390 | 9/1966 | Horwitt | 222/402.11 |
| 3,828,982 | 8/1974 | Steigerwald | 222/153 |
| 3,837,537 | 9/1974 | Baldwin | 222/153 |
| 3,894,665 | 7/1975 | Swenson | 222/153 |
| 3,940,023 | 2/1976 | Umstead | 222/153 |
| 4,582,228 | 4/1986 | Diamond et al. | 222/402.11 |
| 5,131,569 | 7/1992 | Hodgson | 222/153 |

*Primary Examiner*—Andres Kashnikow

*Assistant Examiner*—Philippe Derakshani

*Attorney, Agent, or Firm*—Lerner, David, Littenberg, Krumholz & Mentlik

[57] ABSTRACT

A safety valve locking device is disclosed and includes a collar adapted to fit over a valve rim. A slide member is provided for selectively preventing and permitting the depression of an actuator head arranged on a valve stem to actuate a valve assembly of a pressurized container. The slide member includes a leading end and a trailing end and an aperture arranged therebetween through which the valve stem extends. The slide member is movable when pressure is applied or released from the trailing end thereof, between an occluding position at which the actuator head on a valve stem is misaligned with the aperture so that the valve stem cannot be depressed downwardly therethrough and a nonoccluding position at which the actuator head is aligned with the aperture so that the valve assembly can be actuated upon depression of the valve stem. A plurality of resilient members for urging the slide member to the occluding position are arranged within the inner perimeter of the collar and are connected between the first surface of the collar and the slide member.

18 Claims, 4 Drawing Sheets

SAFETY VALVE LOCKING DEVICE

The present invention relates to safety valve locking devices for use in connection with pressurized containers.

BACKGROUND OF THE INVENTION

Pressurized containers, such as aerosol cans, are commonly used to store and dispense a wide variety of household products such as cleaners, insecticides, paints, cosmetic aids, and the like. These products are generally used by spraying them directly onto their intended target. As can be appreciated, the use of aerosol cans for dispensing such products is desirable in many ways since these products can be used quickly and effortlessly. However, frequently the products dispensed from aerosol cans are toxic especially if ingested or applied to eyes, lungs, or other sensitive areas of anatomy.

The chances of someone being injured because of coming into contact with products dispensed from aerosol cans are greatly enhanced if the aerosol can is used by children.

It is common knowledge that children tend to be inquisitive and if given the opportunity, they will explore or play with various household items left within their reach. Accordingly, hundreds of serious, unnecessary accidents occur every year as a result of unattended children who inadvertently spray a dangerous product from a pressurized container. Thus, a great need exists for effective childproof safety locking devices to solve the problem of inadvertent actuation of pressurized containers.

Safety locking devices to prevent or reduce the likelihood of a child spraying the contents of an aerosol can are known. In fact, considerable effort has been devoted to development of an economical and effective safety valve locking device. Notwithstanding the effort expended to develop such a device, the structure and operation of prior childproof safety locking devices adapted to selectively permit or prohibit depression of an actuator head on a movable valve stem for pressurized containers have shortcomings which have been surmounted by the present invention.

For example, efforts have been made prior to this invention to develop a safety cap for placement over the dispensing mechanism of pressurized cans. However, these safety caps have proven to be undesirable for use as a childproof device. This is due in part to the fact that users of spray products often forget to replace the caps after the product has been used. Thus, if a user inadvertently forgets to replace the cap, the safety caps are rendered entirely ineffective for their intended purpose.

Other past attempts have resulted in childproof safety locking devices arranged to selectively prevent dispensing the contents of an aerosol can. However, attempts also contain several shortcomings. For example, many of these devices include intricate designs which are expensive to manufacture are difficult to assemble or, lend themselves to defective design or have parts that are easily susceptible to fatigue and breakdown of their elastic memory. Other significant shortcomings of prior art devices include structures that are so simple that a young child can figure out how to operate the supposedly childproof safety locking device or actuate the valve that dispenses the spray merely by "playing" with the can and the safety locking devices thereon. Thus, these devices are also completely defective for their intended purpose. Still other prior art locking devices are defective because they contain the serious drawback of not automatically reverting to their locking position once the user has finished spraying the contents from the associated pressurized can. Thus, if the user forgets to place the locking device in its locking position after using the desired product, a young child can actuate the valve assembly thereof. This drawback also renders these locking devices entire ineffective. Examples of prior art devices having some of the foregoing drawbacks can be found in U.S. Pat. Nos. 3,828,982 to Steigerwald; 3,940,023 to Umstead; 3,837,537 to Baldwin; and 3,894,665 to Swenson.

Plainly, despite the great effort expended by prior art designers and manufacturers of safety locking devices for valve assemblies in the pressurized can art, many drawbacks still exist. It is evident from the existence of such drawbacks that there has been a considerable need for an improved safety locking device valve assemblies used for dispensing the contents of pressurized containers which is effective, inexpensive to manufacture and will automatically revert to the locked position when use of the pressurized container is complete. Furthermore, there is also a longstanding but unsolved need for a locking device comprising an adaptable collar for use with any pressurized container.

The present invention solves the aforementioned problems by using a safety locking device having a new and unobvious structure and operation. Accordingly, the use of the present safety locking device will benefit all individuals who are concerned that young children may injure themselves by dispensing the contents of pressurized containers in an undesirable manner.

SUMMARY AND OBJECTS OF THE INVENTION

One aspect of the present invention provides a safety valve locking device for use with pressurized containers comprising a collar adapted to fit over a valve rim of a pressurized can such as an aerosol can. The collar includes a first surface which defines an inner perimeter and a second surface which defines an outer perimeter. A slide means is also provided for selectively preventing and permitting the depression of an actuator head of a valve stem which controls the actuation of a valve assembly of an aerosol can. The slide means includes a leading end and a trailing end and an aperture which defines a passageway therebetween. The valve stem extends upwardly from the valve assembly through the passageway of the slide means. The slide means is slidable, upon pressure applied or released from the trailing end thereof, between an occluding position at which the actuator head on the valve stem is misaligned with the aperture so that the valve stem cannot be depressed and a non-occluding position at which the actuator head is aligned with the aperture so that the valve can be actuated upon depression of the valve stem.

In a preferred arrangement, the safety valve locking device includes resistance means arranged within the inner perimeter of the collar for urging the slide means to the occluding position. In this preferred embodiment, the resistance means are arranged within the inner perimeter of the collar and are connected between the first surface of the collar and the slide means. Thus, when the safety valve locking device of the present invention is in its resting position, i.e., when no external force is applied to the slide means, the resistance means retains the slide means in the occluding position to prevent inadvertent actuation of the valve assembly of the pressurized container.

In a particularly preferred arrangement, the first surface of the collar is adapted to be press-fitted over the valve rim of the pressurized container. Additionally, in one particularly preferred arrangement, the resistance means comprises a plurality of resilient members, each of the resilient members having a first end and a second end. In this embodiment, the first end of the resilient members is connected to the first surface of the collar and the second end is connected to the slide means. Moreover, it is preferable for the plurality of resilient members to comprise arcuate elongate members. In the foregoing particularly preferred arrangement, it is also desirable for the second end of each of the arcuate resilient members to be integrally formed with the slide means between the leading end and the trailing end thereof. Furthermore, in a most preferable arrangement, the slide means includes a cut-out slot arranged adjacent each of the arcuate resilient members toward the leading end of the slide means with respect to the resilient members.

It is also desirable for the collar to include a cut-out portion defining a passageway between the inner perimeter and the outer perimeter thereof wherein the slide means is adapted so that the trailing end extends through the passageway. Most preferably, the slide means comprises an elongate member having a top surface thereon. It is desirable according to this aspect of the present invention for at least a portion of the top surface to be arranged adjacent the actuator head to prevent the actuator head being depressed downwardly when the elongate slide member is arranged in the occluding position.

Another aspect of the present invention provides a stop means arranged within the inner perimeter of the collar for preventing movement of the leading end of the slide means beyond a predetermined position. In a particularly preferred arrangement, the stop means comprises a stop member connected to the first surface of the collar. The stop member is arranged so that the leading end of the slide member will abut the stop member when the slide member is moved into the non-occluding position. In an alternate preferred arrangement, the stop means comprises the combination of the first surface of the collar and the leading end of the slide member. In this preferred arrangement, the slide member is arranged so that the leading end will abut the first surface of the collar when the slide member is moved to the non-occluding position.

Another aspect of the present invention provides a universal safety valve locking device having a collar adapted to fit over a "standard" sized valve rim of a pressurized container. Thus, the universal safety valve locking device can be used with any size pressurized container having such a standard sized valve rim.

Accordingly, it is an object of the present invention to provide a safety valve locking device having a new and unobvious structure and operation which overcomes many of the shortcomings of prior art safety valve locking devices.

It is another object of the present invention to provide a universal safety valve locking device including a collar adaptable to fit over any size pressurized can having a "standard" sized valve rim.

It is another object of the present invention to provide a safety valve locking device which can be efficiently manufactured at a low cost.

It is yet another object of the present invention to provide a safety valve locking device which will automatically revert to its locking position when the user of a pressurized container is finished using same.

It is still another object of the present invention to provide a safety valve locking device which is simple for an adult to use yet is effective in preventing a young child from actuating a valve assembly of a pressurized can.

It is still another object of the present invention to provide a safety valve locking device including novel resistance means which are constructed and arranged to retain its elasticity for a prolonged period of time.

These and other objects of the present invention will be more clearly understood when read in conjunction with the detailed description and the accompanying drawings which follow.

DETAILED DESCRIPTION OF A PREFERRED EMBODIMENT

Figure 1:
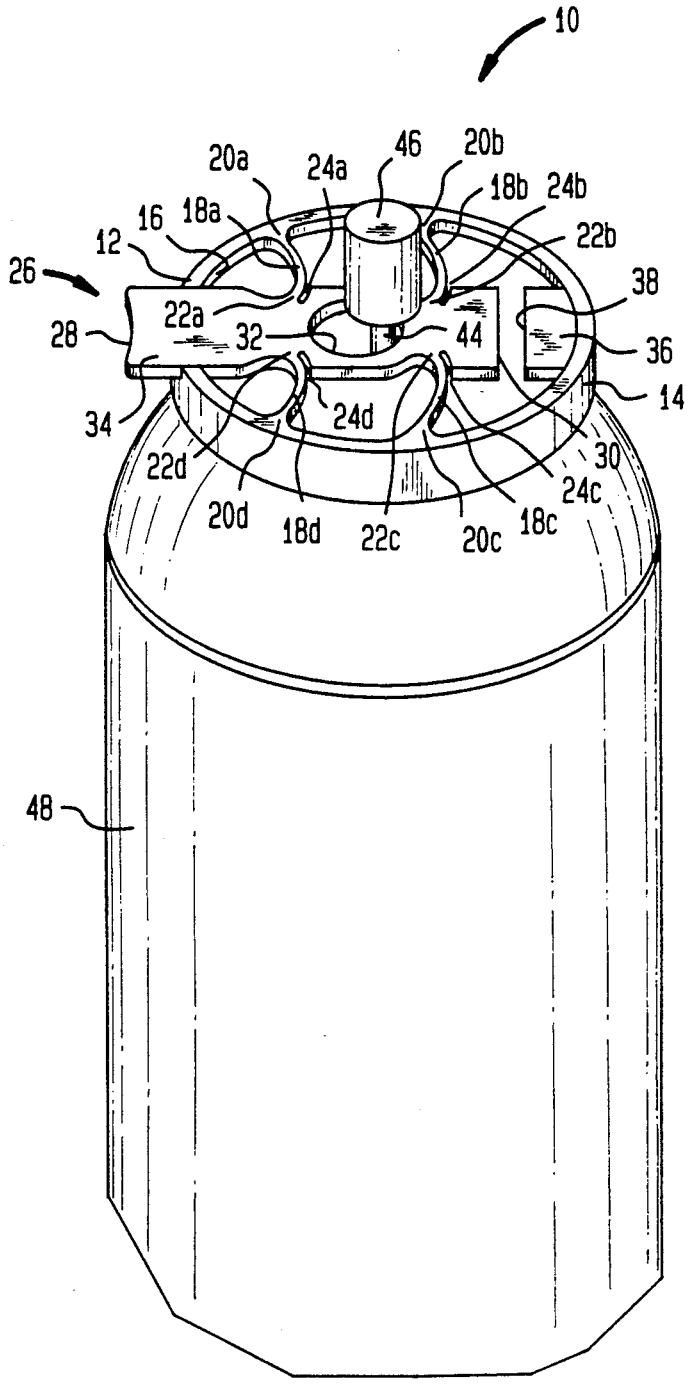
FIG. 1 is a perspective view of one embodiment of the safety locking device of the present invention assembled on a pressurized can.
Figure 2:
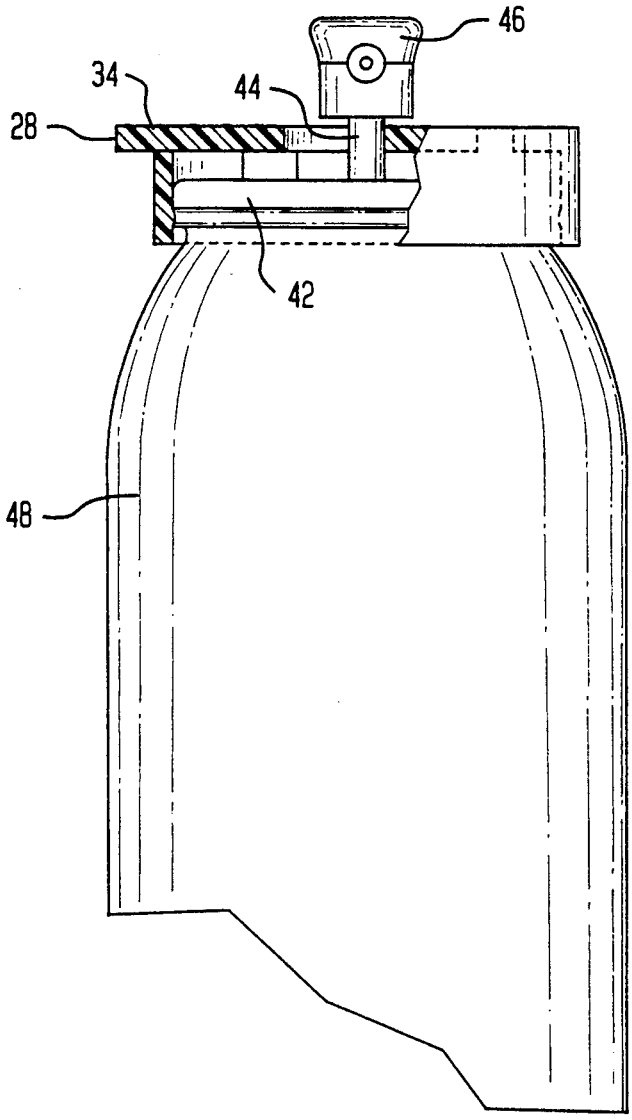
FIG. 2 is a side partial cross-section view of the safety valve locking device shown in FIG. 1 assembled on a pressurized can.

According to a preferred embodiment of the present invention, the safety valve locking device generally designated 10 is clearly disclosed in FIGS. 1–4. The safety valve locking device 10 preferably includes a sized and shaped collar 12 adapted to fit over a rim 42 of a valve assembly for an aerosol can 48 as shown in FIGS. 1 and 2.

The collar 12 includes an outer surface 14 and an inner surface 16. It is preferable for the inner surface 16 of the collar 12 to be press-fitted onto the rim 42 of an aerosol can 48 when the safety valve locking device 10 is in assembled form as shown in FIGS. 1 and 2. In a preferred embodiment of the present invention, the collar 12 is sized and shaped to be universally adaptable to fit over a "standard" sized valve rim. Thus, in this preferred embodiment, the safety locking device 10 can be used with any sized pressurized container including a "standard" sized valve rim. According to this aspect of the present invention, the term "standard sized valve rim" pertains to a valve rim having an outer diameter of approximately 32.4 mm. As can be appreciated, the inner diameter of the collar 12 of the safety valve locking device 10 is not limited in size to correspond with the foregoing diameter of a standard sized valve rim. As will be discussed further hereinbelow, so long as the inner diameter of the collar 12 is adapted to accommodate a friction fit with respect to the rim 42, the size of the pressurized container is irrelevant. Thus, the safety valve locking device 10 is "universal."

Figure 3:
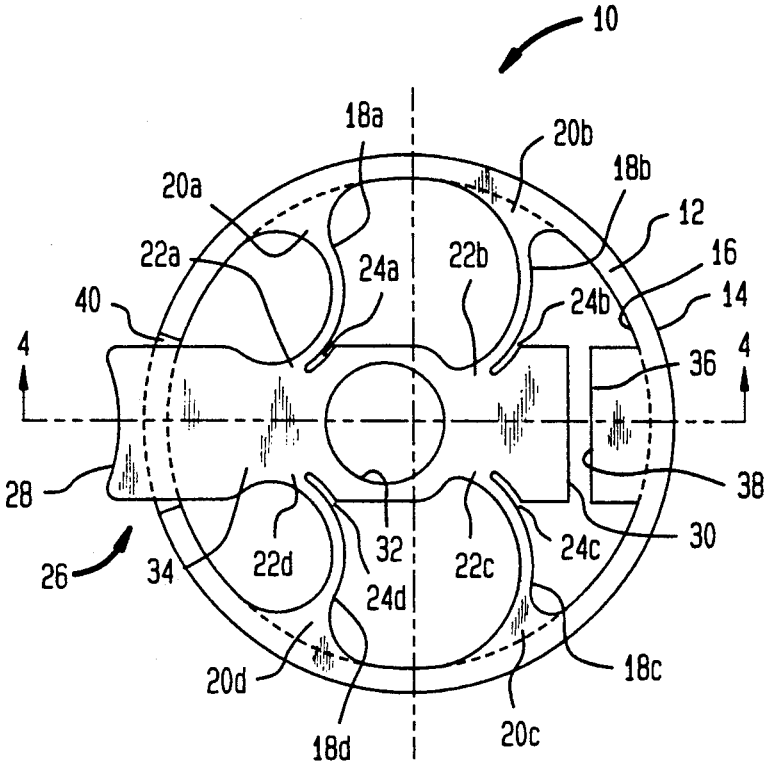
FIG. 3 is an enlarged top plan view of the safety valve locking device shown in FIGS. 1 and 2.
Figure 4:
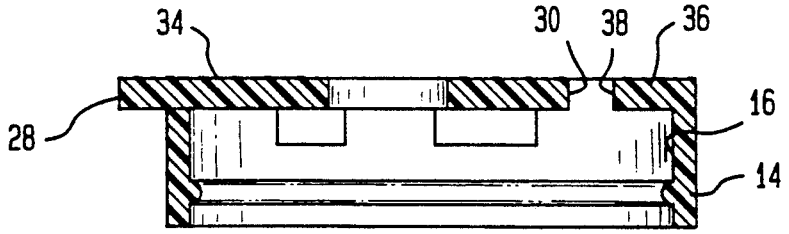
FIG. 4 is a side cross-sectional view taken along line 4—4 of the safety valve locking device shown in FIG. 3.

A slide member generally designated 26 is arranged through a central axis defined by line A-A as shown in FIG. 3. The slide member 26 includes a trailing end 28 and a leading end 30 spaced therefrom. The trailing end 28 is arranged to extend through the passageway 40 in the collar 12.

It is desirable for the slide member 26 to include a circular aperture 32 between the trailing end 28 and the leading end 30. The circular aperture 32 is arranged so that a valve stem 44 extending from a valve assembly of the aerosol can 48 can pass therethrough as clearly shown in FIGS. 1 and 2. An actuator head 46 is arranged on the valve stem 44 above the top surface 34 of the slide member 26 as also shown in FIGS. 1 and 2. The operative relationship between the sized and shaped aperture 32 and the actuator head 46 will be described in detail hereinbelow.

As can best be appreciated with reference to FIGS. 1 and 3, it is preferable for the safety valve locking device 10 to include a plurality of accurate spring members 18*a*–18*d*. Each of the spring members 18*a*–18*d* preferably include a first end 20*a*–20*d*, respectively, which is connected to the inner surface 16 of the collar 12. Additionally, the spring members 18*a*–18*d* include a second end 22*a*–22*d*, respectively, which is preferably connected to a medial portion of the slide member 26 between the trailing end 28 and the leading end 30 thereof. In a preferable embodiment of the present invention, the second end 22*a*–22*d* of the accurate spring members 18*a*–18*d* is medially connected to the slide member 26 between trailing end 28 and leading end 30 thereof.

In a particularly preferable embodiment of the present invention, the second end 22*a*–22*d* of the arcuate spring members 18*a*–18*d* is integrally formed from a medial portion of the slide member 26, as can be best appreciated with reference to FIG. 3. Additionally, in this preferable embodiment, slotted areas 24*a*–24*d* are arranged adjacent, arcuate spring members 18*a*–18*d* , respectively, on the trailing end side of the slide member 26. Furthermore, it is preferable for each of the arcuate spring members 18*a*–18*d* and the slotted areas 24*a*–24*d* to be symmetrically arranged on opposite sides of the slide member 26 and the collar 12. Such an arrangement forms a living-hinge and produces advantageous results with respect to the operation of the present invention which will be discussed more fully hereinbelow.

In another preferable embodiment of the present invention, the safety valve locking device 10 includes a stop member 36 connected to the inner surface 16 of the collar 12. The stop member 36 preferably comprises a contact end 38 arranged at a predetermined spaced distance from the leading end 30 of the slide member 36. The predetermined spaced distance is calculated so that the aperture 32 can be precisely aligned with the bottom surface of the actuator head 46 when it is desirable to permit actuation of the valve assembly of the aerosol can 48.

In operation, the safety valve locking device 10 of the present invention is normally arranged in an occluding position. In this position, the sized and shaped circular aperture 32 is arranged adjacent the bottom surface of the actuator head 46 and is misaligned therewith so that the actuator head 46 cannot be depressed therethrough. Thus, the valve stem 44 cannot be depressed to release the pressurized contents stored within the aerosol can 48. When the slide member 26 is in this occluding position, the trailing end 30 thereof is extended through the cut-out passageway 40 within the collar 12 at it maximum distance from the outer surface 14 thereof.

When it is desirable to release the pressurized contents from the aerosol can 48, a force must be externally applied to the trailing end 28 of the slide member 26 in the direction of the leading end 30. This external force, usually applied by a user's finger, advances the leading end 30 of the slide member 26 toward the contact end 38 of the stop member 36. At the same time, the arcuate spring members 18*a*–18*d* begin to bow outwardly, away from the trailing, end 28. The bowing movement of the arcuate spring members 18*a*–18*d* is facilitated by the adjacent slotted portions 24*a*–24*d* which greatly increase the flexibility of the elastic spring members 18*a*–18*d*.

The advancement of the leading end 30 of the slide member 26 preferably is continuous until it abuts the contact end 38 of the stop member 36. At this time, the sized and shaped circular aperture 32 is aligned directly beneath the bottom surface of the actuator head 26 so that same can be depressed upon the valve stem 44, thereby releasing the pressurized contents from the aerosol can 48.

Figure 5:
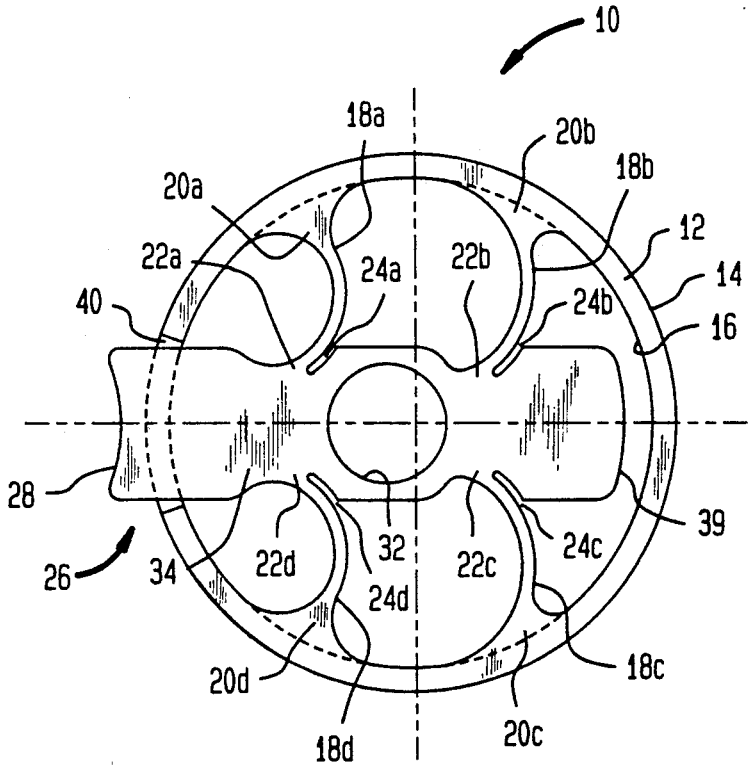
FIG. 5 is an enlarged top plan view of a second embodiment of the safety valve locking device of the present invention.

As can be appreciated, the structure and operation of the stop member 36 can be altered while remaining within the scope of the present invention. Thus, the stop member 36 may be integrally formed with the leading end 30 of the slide member 26. In such a preferred embodiment, the leading end of the slide member 26 will comprise an arcuate end 39 as illustrated in FIG. 5.

As discussed above, the pressurized contents within the aerosol can 48 cannot be dispelled therefrom unless the actuator head 46 is depressed at the same time that the aperture 32 is moved into its nonoccluding position. Thus, pressure must simultaneously be applied to the trailing end 28 of the slide member 26 and the top of the actuator head 46 before any of the contents of the aerosol can 48 can be dispelled therefrom. The simultaneous application of pressure to the trailing end 28 of the slide member 26 and the top of the actuator head 46 requires a level of coordination which can be easily satisfied by an adult. However, the safety-valve locking device 10 is truly "childproof" since a young child would not have the coordination to perform such a simultaneous operation and thus, would not be able to operate the device even if taught how to do so by an adult.

As discussed above, the arcuate spring members 18*a*–18*d* constantly urge the slide member 26, and thus the aperture 32, into its normally static occluding position beneath the actuator head 46. The structure and operation of the unique arcuate spring members 18*a*–18*d* of the present invention ensures that the slide member 26 will automatically return to its occluding position beneath the actuator head 46 upon the removal of pressure from the trailing end 28. This is significant as it may prevent unfortunate mishaps which may arise if the user of an aerosol can having a prior art locking device, such as the locking device disclosed in the Baldwin patent discussed above, accidentally forgets to reload the locking device into a locking position.

The size and shape of the collar 12 of the present safety-valve locking device 10 also provides significant advantages over prior art safety locking devices, such as the device disclosed in the Steigerwald patent discussed hereinabove. An example of one such advantage is the universality feature created by the structure and operation of the collar 12. As can best be appreciated with reference to FIGS. 1 and 2, and as discussed above, the inner surface 16 of the collar 12 is adapted to be press-fitted over the rim 42 of an aerosol can 48. The outer diameter of the aerosol can 48 is irrelevant and can be varied from a standard size, such as 60.0 mm, to a smaller diameter such as 35.0 mm. So long as the outer diameter of the rim 42 is sized and shaped to accommodate a friction fit with respect to the inner surface 16 of the collar 12, the diameter of the base portion of the aerosol can 48 is irrelevant. Thus, the safety-valve locking device 10 of the present invention can be used with various sized aerosol cans.

As can be appreciated, the slide member 26 and the spring members 18*a*–18*d* can be manufactured from a wide variety of materials having satisfactory strength and elasticity characteristics. For example, preferred materials include polypropylene, polyethylene and nylon. Preferably, the entire safety-valve locking device 10, including the collar 12, is manufactured from a single mold and therefore, the collar 12 is also preferably made of polypropylene, polyethylene or nylon. However, it should be appreciated that the collar 12 can also be manufactured separate component and can thus be made of any durable plastic material or suitable polymer. The unique structure and operation of the arcuate spring members 18*a*–18*d* in combination with the slotted portions 24*a*–24*d* results in advantages over spring members of prior art locking devices, such as increased flexibility and a greatly increased lifespan of the elasticity of the spring members 18*a*–18*d* and thus a minimal chance of spring failure due to fatigue. These advantages have not heretofore been achieved in prior art safety-locking devices.

Another significant advantage of the safety-valve locking device 10 is directly related to its unitary structure which permits the present invention to be manufactured at an extremely low cost. Further, since the safety-valve locking device 10 can be universally used with any standard sized valve rim, such as valve rim 42, it can be sold in convenient packages and can be placed into assembled position in a consumer's home in situations when the manufacturer or the retailer of the product within the aerosol can does not include a safety-locking device as part of the assembled unit.

While the foregoing description and figures are directed toward the preferred device in accordance with the present invention, it should be appreciated that numerous modifications can be made to each of the components of the safety valve locking device as discussed above, and are indeed encouraged to be made in the materials and structure of the disclosed embodiments of the present invention without departing from the spirit and scope of same.

Thus, the foregoing description of the preferred embodiments should be taken by way of illustration rather than by way of limitation of the present invention as defined by the following claims.

I claim:

1. A safety valve locking device for use with pressurized containers comprising:

a collar adapted to fit over a valve rim, said collar having a first surface defining an inner perimeter and a second surface defining an outer perimeter;

slide means operatively connected to said collar for selectively preventing and permitting depression of a valve stem to actuate a valve, said slide means having a leading end and a trailing end and an aperture therebetween defining a passageway through which the valve stem extends, and being slidable upon pressure applied to or released from said trailing end between an occluding position at which an actuator head on the valve stem is misaligned with said aperture so that the valve stem cannot be depressed therethrough and a nonoccluding position at which said actuator head is aligned with said aperture so that the valve stem can be actuated upon depression of the valve stem; and resistance means arranged within said inner perimeter of said collar for urging said slide means to said occluding position, said resistance means extending from said first surface of said collar and between said leading and trailing ends of said slide means.

2. The safety valve locking device of claim 1 wherein said first surface of said collar is adapted to be press-fitted over said valve rim.

3. The safety valve locking device of claim 1 wherein said resistance means comprises a plurality of resilient members, each of said resilient members having a first end and a second end, said first end of said resilient members being connected to said first surface of said collar and said second end being connected to said slide means.

4. The safety valve locking device of claim 3 wherein said plurality of resilient members comprise arcuate elongate members.

5. The safety valve locking device of claim 4 wherein said second end of each of said resilient members being integrally formed with said slide means between said leading end and said trailing end thereof, said slide means having a cut-out slot adjacent each of said resilient members, said cut-out slots being arranged toward the leading end of said slide means with respect to said resilient members.

6. The safety valve locking device of claim 1 wherein said collar includes a cut-out portion defining a passageway between said inner perimeter and said outer perimeter thereof, said slide means being adapted so that said trailing end extends through said passageway.

7. The safety valve locking device of claim 6 wherein said slide means comprises an elongate member having a top surface thereon, at least a portion of said top surface being arranged adjacent the actuator head when said slide means is arranged in said occluding position.

8. The safety valve locking device of claim 1 further including stop means arranged within the inner perimeter of said collar for preventing movement of said leading end of said slide means beyond a predetermined position.

9. The safety valve locking device of claim 8 wherein said stop means comprises a stop member connected to said first surface of said collar, said stop member being arranged so that said leading end of said slide means will abut said stop member when said slide means is moved into said nonoccluding position.

10. The safety valve device of claim 8 wherein said stop means comprises the combination of said first surface of said collar and said leading end of said slide means, said slide means being arranged so that said leading end will abut said first surface when said slide means is moved to said nonoccluding position.

11. A universal safety valve locking device for use with a pressurized container comprising:

a collar adapted to fit over a valve rim, said collar having a first surface defining an inner perimeter and a second surface defining an outer perimeter;

slide means operatively connected to said collar for selectively preventing and permitting depression of a valve stem to actuate a valve, said slide means having a leading end and a trailing end and an aperture therebetween defining a passageway through which the valve stem extends, and being slidable upon pressure applied or released from said trailing end between an occluding position at which an actuator head on the valve stem is misaligned with said aperture so that the valve stem cannot be depressed therethrough and a nonoccluding position at which said actuator head is aligned with said aperture so that the valve can be actuated upon depression of the valve stem; and resistance means arranged within said inner perimeter of said collar for urging said slide means to said occluding position, said resistance means comprising arcuate elongate resilient members having a first end and a second end, said first end of said accurate elongate resilient members being connected to said first surface of said collar and said second end being connected to said slide means between said leading end and said trailing end thereof.

12. The safety valve locking device of claim 11 wherein said collar includes a cut-out portion defining a passageway between said inner perimeter and said outer perimeter thereof, said slide means being adapted so that said trailing end extends through said passageway.

13. The safety valve locking device of claim 12, wherein said slide means comprises an elongate member having a top surface thereon, at least a portion of said top surface being arranged adjacent the actuator head on said valve stem when said slide means is arranged in said occluding position.

14. The safety valve locking device of claim 13, wherein said second end of each of said arcuate resilient members being integrally formed with said slide means between said leading end and said trailing end thereof, said slide means having a cut-out slot adjacent each of said resilient members, said cut-out slots being arranged toward the leading edge of said slide means with respect to said resilient members.

15. The safety valve locking device of claim 14 wherein said collar defining a center axis therethrough, said elongate slide member being arranged through said center axis of said collar.

16. The safety valve locking device of claim 15 wherein said accurate resilient members comprise at least four accurate members, at least two of said arcuate members being disposed on one side of said central axis and at least two of said accurate members being disposed on the other side of said central axis.

17. The safety valve locking device of claim 16 wherein said first surface of said collar is adapted to be press-fitted over said valve rim.

18. The safety valve device of claim 17 further including stop means arranged within the inner perimeter of said collar for preventing movement of said leading end of said elongate slide member beyond a predetermined position.

* * * * *

UNITED STATES PATENT AND TRADEMARK OFFICE

CERTIFICATE OF CORRECTION

PATENT NO. : 5,282,551

DATED : February 1, 1994

INVENTOR(S) : Pierson

It is certified that error appears in the above-identified patent and that said Letters Patent is hereby corrected as shown below:

Column 2, line 10, "entire" should read --entirely--.
Column 5, line 20, "accurate" should read --arcuate--.
Column 10, line 18, "accurate" should read --arcuate--.
Column 10, line 19, "accurate" should read --arcuate--.
Column 10, line 21, "accurate" should read --arcuate--.

Signed and Sealed this

Fifth Day of July, 1994

Bruce Lehman

*Attest:*

BRUCE LEHMAN

*Attesting Officer*

*Commissioner of Patents and Trademarks*